US005758468A

United States Patent [19]

Focke et al.

[11] Patent Number: 5,758,468

[45] Date of Patent: Jun. 2, 1998

[54] APPARATUS FOR CONVEYING PACKS

[75] Inventors: Heinz Focke, Verden; Hans-Jürgen Bretthauer, Bremen, both of Germany

[73] Assignee: Focke & Co., Verden, Germany

[21] Appl. No.: 703,702

[22] Filed: Aug. 27, 1996

[30] Foreign Application Priority Data

Aug. 30, 1995 [DE] Germany ..... 195 32 092.1

[51] Int. Cl.[6] ..... B65B 19/22; B65B 43/50

[52] U.S. Cl. ..... 53/234; 53/225; 53/252

[58] Field of Search ..... 53/234, 252, 251, 53/250, 228, 566, 233, 232, 225, 253

[56] References Cited

U.S. PATENT DOCUMENTS

| | | | |
|---|---|---|---|
| 3,922,837 | 12/1975 | David | 53/234 |
| 4,258,526 | 3/1981 | Focke | 53/399 |
| 4,936,440 | 6/1990 | Focke et al. | 53/234 X |
| 5,009,741 | 4/1991 | Focke et al. | 53/234 X |
| 5,544,467 | 8/1996 | Focke | 53/234 X |

FOREIGN PATENT DOCUMENTS

| | | |
|---|---|---|
| 3573 | 6/1979 | European Pat. Off. . |
| 529689 | 10/1987 | European Pat. Off. . |
| 317805 | 5/1989 | European Pat. Off. . |
| 2218247 | 9/1974 | France . |
| 2244533 | 4/1974 | Germany . |
| 3046065 | 6/1982 | Germany . |
| 2858074 | 8/1985 | Germany . |
| 3815275 | 11/1989 | Germany . |
| 3903933 | 8/1990 | Germany . |
| 4042179 | 7/1991 | Germany . |
| 4300149 | 7/1994 | Germany . |
| 2097357 | 4/1981 | United Kingdom . |

*Primary Examiner*—James F. Coan

*Attorney, Agent, or Firm*—Sughrue, Mion, Zinn, Macpeak & Seas, PLLC

[57] ABSTRACT

A special transfer turret (15) is used for conveying packs (10) from, for example, a folding turret to a drying turret. The transfer turret transports the packs (10) along a circular path or partially circular path and in the axial direction at the same time. For this purpose, pockets (16) for packs (10) are fitted on carrying rods (28) which are displaced in an axis-parallel direction during the rotation and in accordance with the same.

20 Claims, 4 Drawing Sheets

APPARATUS FOR CONVEYING PACKS

BACKGROUND OF THE INVENTION

The invention relates to an apparatus for conveying articles, in particular packs, in conjunction with a packaging machine, for example for transferring the packs from a folding unit (folding turret) to another unit (drying turret), the packs being received in pack holders—pockets—and being transported by these.

In complex packaging installations, in particular for the production of cigarette packs, the task of transferring the completely or partially finished packs or the pack contents from one treatment unit to the next, in particular from a folding turret to a subsequent unit, poses a particular problem. The progression of the process steps, on the one hand, and lack of space, on the other hand, may result in the successive treatment units for the packs being positioned in a spatially unfavorable manner relative to one another.

SUMMARY OF THE INVENTION

The invention deals with the subject of handling, that is to say in particular the transportation, of the packs within a packaging machine, to be precise primarily during the transfer from a folding turret to another treatment turret, namely to a drying turret.

By virtue of a corresponding relative position of the units following one after the other in the production flow, the apparatus according to the invention is defined by the fact that the packs or the pockets for receiving the packs can be moved in a superposed movement along a (partial) arc of a circle and in the axial direction of said arc.

This movement path of the packs is such that the packs are transferred in one movement cycle to a receiving unit which is in an axis-parallel position with respect to the discharging unit, but is arranged in an offset plane.

According to a further feature of the invention, the pack holders or pockets are part of a conveyor, namely a transfer turret, which can be moved in rotation. Arranged at equal spacings on the circumference thereof are a plurality of pockets, each for receiving a pack from a first unit, in particular a folding turret, and for discharging said pack to a second unit which is offset in the axial direction, in particular to a drying turret.

According to the invention, the pockets or the like are mounted displaceably on axis-parallel guides of the transfer turret, in particular on carrying rods, such that, during the (continuous) rotation of the transfer turret, the pockets analogously perform a displacement in the longitudinal direction, that is to say in the axis-parallel direction of the transfer turret. This movement in the axial direction is preferably effected by sensing members which are connected (indirectly) to the pockets and pass into a stationary peripheral guide or control groove.

The pockets are also designed in a particular manner, such that they interact with the pockets of the transferring folding turret and with the pockets of the drying turret as the packs are received and transferred.

Further features of the invention are explained hereinbelow with reference to an exemplary embodiment of the apparatus illustrated in the drawings, in which:

DESCRIPTION OF A PREFERRED EMBODIMENT

Figure 1:
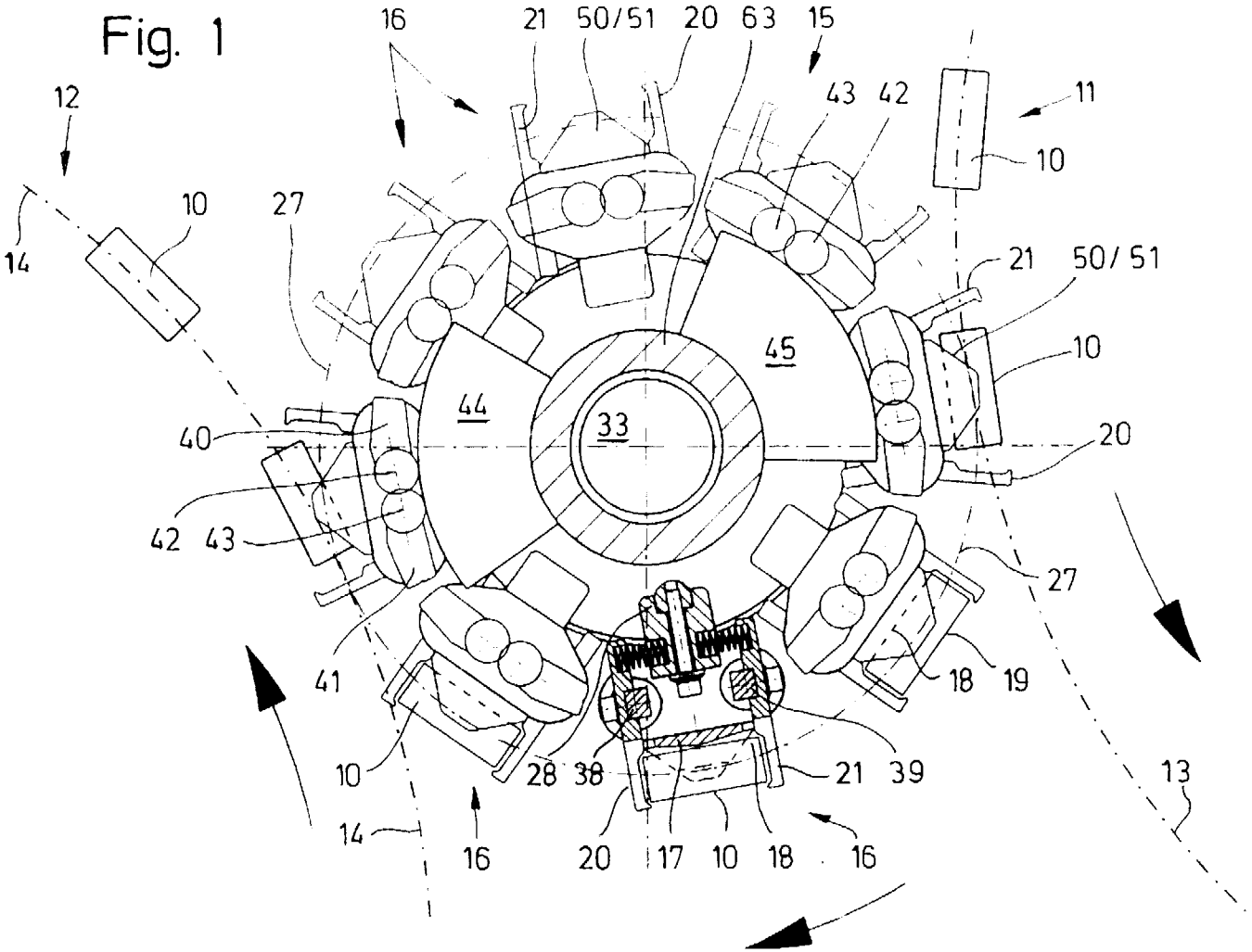
FIG. 1 shows a section transverse to the axis of a transfer turret, along section plane I—I in FIG. 2.

The exemplary embodiment shown deals with the handling of cuboidal packs 10. These may be cigarette packs of the soft-carton-pack type. The aim is to transport said packs 10 from one unit to a subsequent unit within a packaging machine. The discharging unit may be a folding turret 11. In the production of packs 10 of the soft-carton type, the folding turret 11 is used for producing the carton wrapper.

The means which receive the packs 10 may be a drying turret 12. The latter is provided with pack-receiving means (not shown) in which the packs 10 are retained in order that glued locations can harden and the contours of the packs 10 can be stabilized. The drying turret 12 is preferably designed in the manner illustrated and described in EP 0 605 838. The folding turret 11 may correspond to the configuration described and illustrated in EP 0 226 872.

The folding turret 11 and drying turret 12 are arranged in vertical planes, that is to say with a horizontal axis of rotation and preferably with a continuous drive. Said means are arranged at an axial distance from one another, such that a central movement path 13 of the packs 10 in the region of the folding turret 11 is at a distance from a corresponding central movement path 14 of the packs 10 in the region of the drying turret 12. A further special feature is that folding turret 11 and drying turret 12 are arranged such that they are offset in the axial direction with respect to one another. Accordingly, the upright plane of the folding turret 11 is at an axial distance from the upright plane of the drying turret 12. The intention is for the packs 10 to be transferred from the folding turret 11 to the drying turret 12 in one movement or conveying cycle. For this purpose, a transfer turret 15 is provided as the conveying means for the packs 10.

The transfer turret 15 is an intermediate conveyor for the packs 10. It receives the packs 10 from the folding turret 11 and transports them to the drying turret 12 along an arc of a circle and, in addition, in the axial direction.

The transfer turret 15 is provided with at least one holder for a pack 10, in the present case with a plurality of pockets 16 arranged at equal spacings from one another along the circumference. During the transportation by the transfer turret 15, the cuboidal packs 10 rest against a pocket base 17, to be precise by means of a large pack surface, for example the front surface 18, with the result that an opposite rear surface 19 is directed radially outward.

The pocket 16 is bounded laterally by pocket walls 20, 21. When the pocket 16 is closed (FIGS. 1 and 4), said pocket walls rest against narrow, elongate side surfaces 22, 23 of the pack 10.

The side walls 22, 23 of the pockets 16 are arranged movably, that is to say they are mounted pivotably. In the closed position, the side walls 22, 23 are directed approximately parallel to one another. In the open position, for receiving or discharging a pack 10, the pocket walls 20, 21 are located in a spread-apart position (FIG. 1). As can be seen from FIG. 2, each pocket wall 20, 21 comprises spaced-apart fingers 24, 25. There is a gap 26 between these fingers.

This configuration of the pockets 16 and pocket walls 20, 21 makes it possible for the packs to be transferred from one turret to the other in a particular manner. Pockets of the folding turret 11, on the one hand, and of the drying turret 12, on the other hand, are provided with side walls which, in terms of the fingers and gaps, correspond with the fingers 24, 25 and the gap 26 of the pockets 16. The fork-like or comb-like pocket walls of the turrets may thus be moved past one another without mutual contact. It is therefore possible to transfer the packs 10 from one turret to the other without radial movement. The packs 10 conveyed along the movement path 13 in the region of the folding turret 11 are received, when the pocket 16 is open, by the transfer turret 15 without radial displacement of the pack 10 (FIG. 1). In the region of the drying turret 12, the packs 10 are transported on a movement path 27 which, in the region of transfer of the pack 10, comes into contact with the movement path 13 of the folding turret 11 and, approximately opposite this, with the movement path 14 of the drying turret 12. Here too, transfer takes place without radial displacement. The movement operations are illustrated and described in detail in EP 0 605 838.

The pockets 16 convey the packs 10 along a partially circular path, that is to say approximately a semicircular path. Furthermore, the pockets 16 are moved in the axial direction of the turrets, in order to overcome an offset between the folding turret 11 and drying turret 12 in the axial direction. For this purpose, each pocket 16 is arranged on a carrier, to be precise on a carrying rod 28 which runs in an axis-parallel manner. Each carrying rod 28 can be displaced in the axial direction, with the pocket 16 fastened on it, during the rotation of the transfer turret 15. As a result, the pocket 16 passes out of the initial position, which is shown at the top in FIG. 2, into the end position, which is illustrated at the bottom. These relative positions correspond to the axial offset of the folding turret 11 and drying turret 12.

Figure 2:
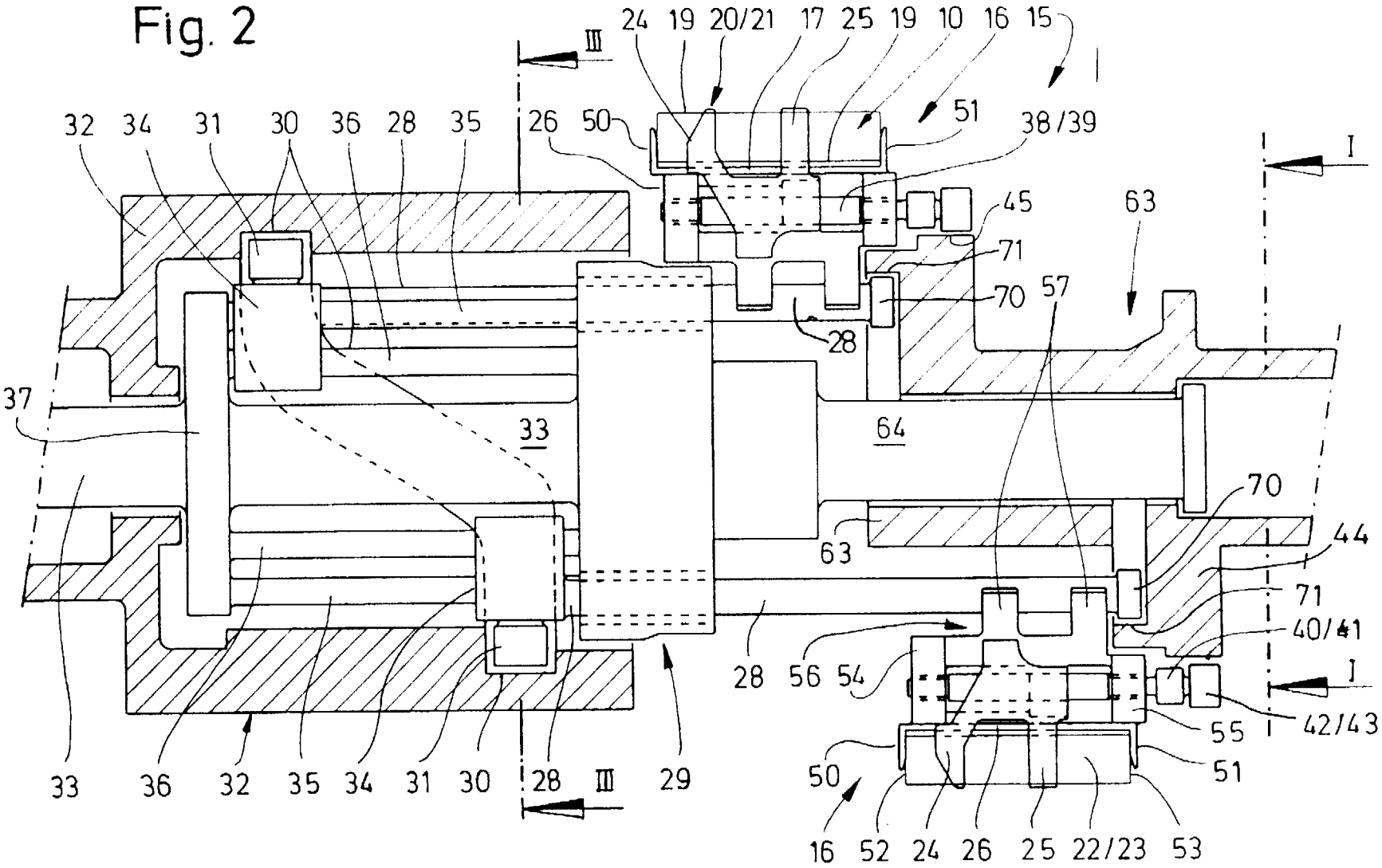
FIG. 2 shows a longitudinal or axial section of the transfer turret.

The carrying rods 28 are mounted in a carrying member such that they can be displaced in the longitudinal direction; in the exemplary embodiment shown, they are mounted in a carrying body 29 which is designed as a disk and is preferably of circular cross-section. The carrying rods 28 can be displaced in a sliding manner in bores of the carrying body 29 from a position which is shown at the top of FIG. 2 into the position which is shown at the bottom.

In the present case, the axial movement of the carrying rods 28 is effected by a stationary control groove 30. A sensing element, namely a sensing roller 31, assigned to each carrying rod 28 passes into said control groove. The control groove 30 is of a curved shape, with the result that, when the transfer turret 15 rotates relative to the control groove 30, sensing roller 31 running in the latter causes the carrying rod 28 to be displaced axially back and forth in accordance with the shape of the control groove 30. Half of the control groove 30 can be seen in FIG. 2. The corresponding section which is not shown effects the return movement of the carrying rods 28.

The control groove 30 is formed on the inside of a fixed housing 32. The latter encloses the control or actuating region of the transfer turret 15 in the manner of a pot which is open on one side. A shaft 33 passes into the housing 32 in the region of a base. The carrying body 29 forms a termination of the housing 32 in the region of the open side, with the result that, with the aid of suitable seals, said housing may have the overall design of an oil container for the constant lubrication of the movable parts.

In order to transmit the back-and-forth thrust movements to the carrying rods 28, the latter are fastened, by one end, on a carriage 34 in each case. The sensing roller 31 which passes into the control groove 30 is fitted laterally on said carriage. By virtue of the sensing roller 31 running in the control groove 30, the carriage 34, and thus the carrying rod 28 fitted on it, is displaced in the manner described. Each carriage 34 is mounted in a sliding manner on a guide, in the present case in each case on two spaced-apart guide rods 35, 36. These are connected, at one end, to the carrying body 29 and, at the opposite end, to a retaining disk 37 which is oriented transversely to the axial direction. This, in turn, is mounted—just as the carrying body 29—on the shaft 33, with the result that, when said retaining disk is driven in rotation, the carrying mechanism, comprising the carrying body 29, the retaining disk 37, and the guide rods 35, 36, is driven in rotation within the housing 32, the carrying rods 28 with the pockets 16 arranged on it being taken along in the process.

The pockets 16 are designed in a particular manner in order to fulfil the functions which have been described, inter alia. The lateral pocket walls 20, 21 are mounted in each case on rotary shafts 38, 39 in order to execute the pivot movement. A transversely directed pivot lever 40, 41 is fitted at one end of each rotary shaft 38, 39. A running roller 42, 43 is, in turn, located at the end of said pivot lever. These rollers are positioned such that they run on control segments 44, 45 in the region of the pocket opening, that is to say with spread-apart pocket walls 20, 21. These control segments are stationary actuating members for the pocket walls 20, 21, which are active only in those regions of rotation of the transfer turret 15 in which the pockets 16 are to assume an open position for receiving or discharging a pack 10. The opening movement of the pocket walls 20, 21 is triggered by a rotary movement of the rotary shafts 38, 39 in the opposite direction as soon as the running rollers 42, 43 reach the outer running path of the control segments 44, 45.

Figure 4:
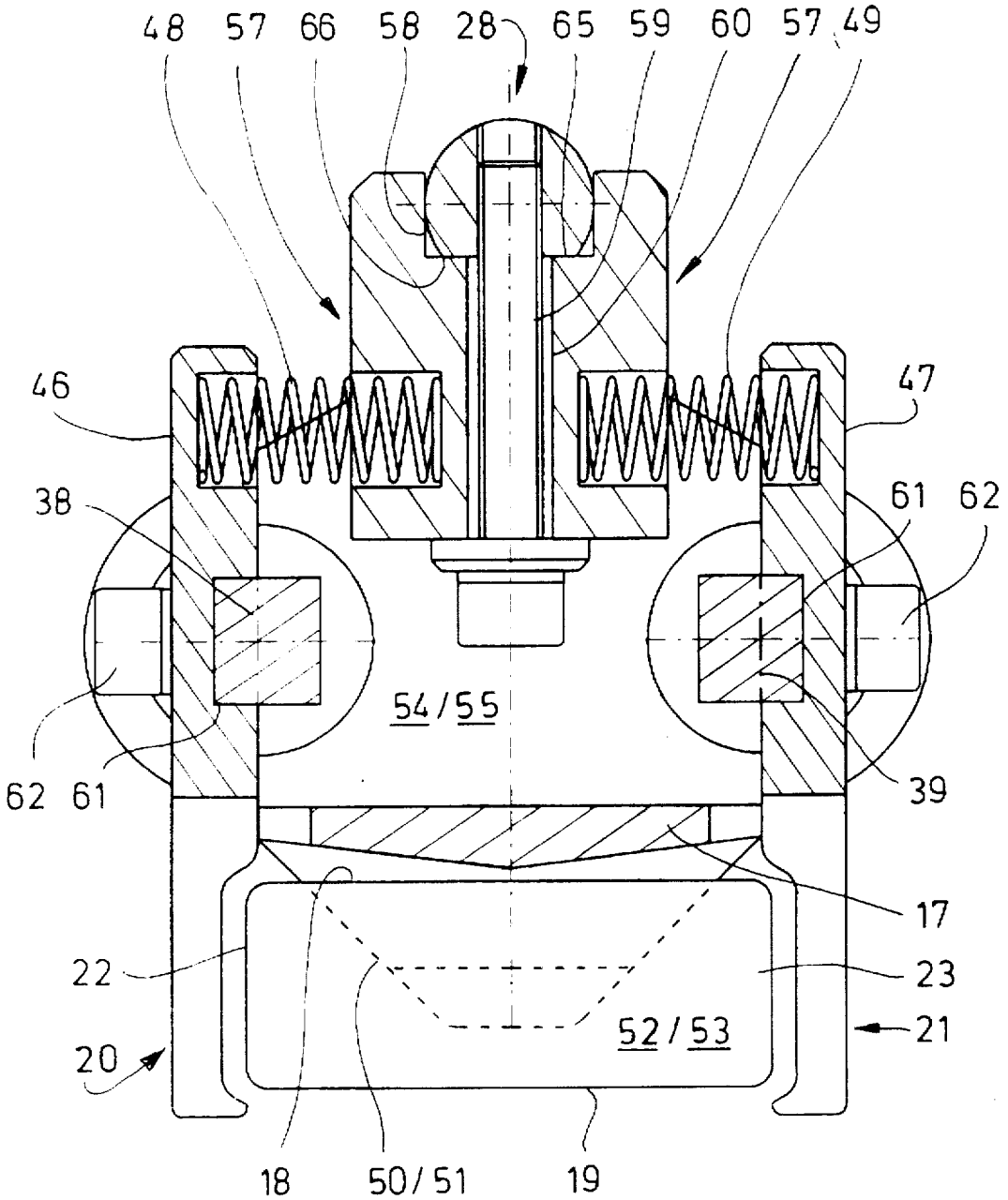
FIG. 4 shows, on an enlarged scale, a pocket of the transfer turret, in a section transverse to the axis of said turret.

In the present case, the pocket walls 20, 21, are designed as two-armed levers. A wall continuation 46, 47 extends radially inward beyond the rotary shafts 38, 39. The wall continuations 46, 47 are supported on elastic pressure-exerting elements, in the present case on compression springs 48, 49. The compression springs 48, 49, which may be prestressed, load each pocket wall 20, 21 into the closed position (FIG. 4). Accordingly, the opening movement is performed counter to the action of these compression springs 48, 49.

The pocket base 17, which is of a roof-shaped design in cross-section, is provided, at the ends, with end walls 50, 51, which are of a trapezoidal configuration in the present case. These end walls rest in each case against end walls 52, 53 of the packs 10.

Toward the inside in the radial direction, the pocket base 17 is supported on a connecting piece 56 via two spaced-apart carrying webs 54, 55. Said connecting piece is used for fitting the pockets 16 laterally, that is to say eccentrically, on the carrying rod 28. For this purpose, two spaced-apart connecting webs 57 are seated on the connecting piece 56. These connecting webs are provided in each case with an open, cross-sectionally approximately U-shaped recess 58. The dimensions of the latter, in particular the width thereof, correspond to the transverse dimension of the carrying rod 28. A sub-region of the cross-section of the carrying rod 28 passes into the recesses 58, and the carrying rod is anchored here by a retaining screw 59 which is oriented transversely to the axial direction. The retaining screw 59 passes through a bore 60 in the region of the connecting piece 56 and of the connecting webs 57.

The rotary shafts 38, 39 are mounted rotatably, by means of their ends, in the carrying webs 54, 55. In the region of connection to the pocket walls 20, 21, the rotary shafts 38, 39 are designed with a polygonal or rectangular cross-section (FIG. 4). A sub-region of the rotary shaft 38, 39 is fitted in a corresponding depression 61 of the pocket wall 20, 21. A transversely directed connecting screw 62 holds said parts together.

The two control segments 44 and 45 form part of a stationary carrying piece 63. Furthermore, a shaft piece 64 which adjoins the carrying body 29 is mounted rotatably in said carrying piece 63.

The position and configuration or dimensions of the control segments 44 and 45 are coordinated with the shape of the control groove 30. The movements are selected such that the carrying rods 28 and the pockets 16 are moved in the axial direction only in the region where the transfer turret 15 rotates between the control segments 44, 45. Accordingly, the pockets 16 located in the region of the control segments 44, 45 are not moved in the axial direction, but rather only in the circumferential direction, this ensuring a precise relative position of the pockets of the adjacent turrets 11, 12 for the transfer of the packs 10. The shape of the control groove 30 permits these movement characteristics.

A further special feature is found in measures which ensure rapid assembly of parts of the apparatus, specifically a precise and functionally correct relative positioning of elements which are to be connected to one another being achieved in the process. These are elements which have to be removed relatively frequently for repair work, maintenance, etc. and assembled again.

In this respect, the pockets 16 are fitted on the carrying rods 28 in a particular manner. The carrying rods 28 are provided, in a sub-region, with a flattened portion 65 on one side. Said flattened portion extends at least in the region where the pocket 16 or the connecting webs 57 rest against the carrying rod 28, which is otherwise designed with a round, circular cross-section. The flattened portion 65 forms a planar bearing surface which fits in a positively locking manner against an inner surface 66 of the recess 58 in the connecting webs 57. This geometric interrelationship ensures that the relative positioning, namely the angular positioning, between the carrying rod 28, on the one hand, and the pocket 16, on the other hand, is always reproduced precisely even in the event of repeated assembly, to be precise by virtue of said parts being joined together and connected by the retaining screw 59. This precise relative positioning of the pocket 16 on the associated carrying rods 28 is important for the functioning, in particular for the transfer and reception of the packs 10.

Figure 3:
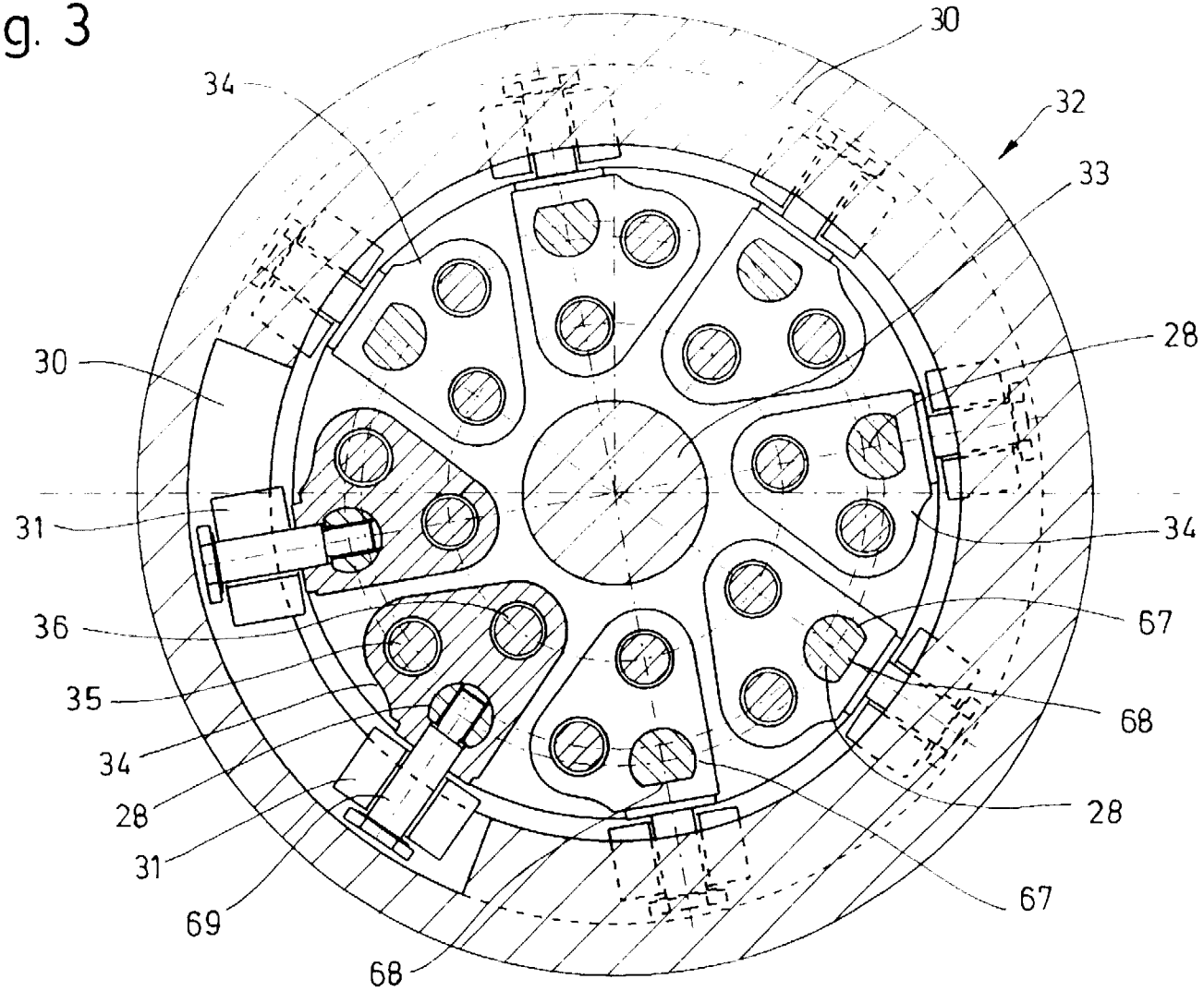
FIG. 3 shows a detail of the transfer turret, in a section transverse to the axis of said turret, along section plane III—III of FIG. 2.

Analogously, the sensing rollers 31 are fitted laterally on the carrying rods 28 such that, here too, precise, predetermined angular positioning is reliably ensured. For this purpose, the end regions of the carrying rods 28 are mounted in bores 67 of the carriages 34, these likewise having a non-round cross-section. In the exemplary embodiment shown (FIG. 3), this non-round cross-section is constituted by a flattened portion 68 which matches a corresponding flat portion of the carrying rod 28. The relative or angular positioning between the end of the carrying rod 28, on the one hand, and the carriage 34, on the other hand, is always precisely predetermined by the flattened portions 68 resting against one another. The connection is effected here by a radial screw 69 which is guided through the carriage 34 in the region of the flattened portion 68 and passes into the carrying rod 28. In the present case, the sensing roller 31 is mounted on the radial screw 69 in each case.

The free ends of the carrying rods 28 are supported in the radial direction in certain regions during the rotary movement of the transfer turret 15, to be precise against loading toward the outside in the radial direction, in particular for absorbing centrifugal forces. As can be seen from FIG. 2, the free ends of the carrying rods 28 which are adjacent to the respective pocket 16 are supported by supporting rollers 70. During some of the rotary movement, said supporting rollers rest against outer, fixed, partially circular supporting paths 71. These are designed as partially circular surfaces of the control segments 44, 45. By virtue of this support, the pockets 16 assume a very precise position during the transfer operation.

The principle of the transfer turret 15 may also be used for other instances of conveying articles with superposed movement. Furthermore, other actuating members for the carrying rods 28 are possible.

What is claimed is:

1. An apparatus for transferring packs (10) from a rotating circular folding turret (11) to a rotating circular drying turret (12), said apparatus comprising a rotating circular transfer turret (15) having pockets (16) in which the packs (10) are received and are transported thereby, wherein the pockets (16) with the packs (10) are movable in superposed movements along an arc of a circle and in an axial direction of said arc; and wherein the folding, drying and transfer turrets rotate about respective axes which are parallel to each other and which extend in said axial direction; and wherein:

a) the transfer turret (15) is mounted in an axis-parallel manner between the folding turret (11) and the drying turret (12) which is arranged at an axial distance from said folding turret;

b) the folding turret (11) and the drying turret (12) are arranged in upright planes which are offset in the axial direction; and c) the transfer turret (15) is positioned between the folding turret (11) and the drying turret (12) such that movement paths (13, 14) of the packs (10) in a region of the folding turret (11) and in a region of the drying turret (12) come into contact with a movement path (27) of the packs (10) in a region of the transfer turret (15).

2. An apparatus for transferring packs (10) from a rotating circular folding turret (11) to a rotating circular drying turret (12), said apparatus comprising a rotating circular transfer turret (15) having pockets (16) in which the packs (10) are received and are transported thereby, wherein the pockets (16) with the packs (10) are displaced in superposed movements along an arc of a circle and in an axial direction of said arc; and wherein the folding, drying and transfer turrets rotate about respective axes which are parallel to each other and which extend in said axial direction; and wherein each of the pockets (16) is connected in a positively locking manner to their carriers, in particular the carrying rods (28), in the region of non-circular cross-section, in particular in the region of flattened portions (65).

3. An apparatus for transferring packs (10) from a rotating circular folding turret (11) to a rotating circular drying turret (12), said apparatus comprising a rotating circular transfer turret (15) having pockets (16) in which the packs (10) are received and are transported thereby, wherein the pockets (16) with the packs (10) are displaced in superposed movements along an arc of a circle and in an axial direction of said arc; wherein the folding, drying and transfer turrets rotate about respective axes which are parallel to each other and which extend in said axial direction;

wherein each of the pockets (16) of the transfer turret (15) is fastened on a carrying rod (28) which can be moved back and forth in the axis-parallel direction, carrying the rod (28) and the pocket (16) rotating about the transfer turret's axis during the displacement in the axial direction;

wherein pockets (16) are fastened in a laterally offset manner, radially outwardly directed manner, on the carrying rods (28), by connecting webs (57) which partially enclose the carrying rods laterally;

wherein the pockets walls (20, 21) of the pockets (16) are always biased in a closing direction by spring elements (48, 49); and wherein each of the connecting webs (57) has a cross-sectionally U-shaped recess (58) into which the carrying rod (28) passes by means of at least a sub-region of the cross-section, a flattened portion (65) of each carrying rod (28) resting against a corresponding inner surface (66) of the recess (58).

4. An apparatus for transferring packs (10) from a circular rotating first turret (11) to a circular rotating second turret (12) which is disposed at a radial distance from the first turret, said apparatus comprising a circular rotating transfer turret (15) having pockets (16) arranged along a circumference thereof, each pocket receiving one pack (10) to be transferred from the first turret to the second turret; wherein:

the first, second and transfer turrets rotate about respective axes which extend in an axial direction and which are parallel to each other;

the first turret (11) and the second turret (12) are spaced from one another in the axial direction;

the transfer turret (15) is located axis-parallel between the first turret (11) and the second turret (12), so that the packs (10) can be transferred from the first turret (11) to the pockets (16) of the transfer turret (15), and from said pockets (16) to the second turret (12); and the pockets (16) of the transfer turret (15), during the rotational movement of the transfer turret (15), are displaced in the axial direction along a helical path of movement.

5. The apparatus as claimed in claim 4, wherein the pockets (16) of the transfer turret (15) are each fastened on carrying rods (28), which can be moved back and forth in the axial direction, each carrying rod (28) and pocket (16) rotating about the transfer turret's axis during the displacement in the axial direction.

6. The apparatus as claimed in claim 5, wherein the the axial displacement of pockets (16) is effected by at least one fixed control groove (30) in which sensing rollers (31), which are connected to the pocket (16) or the carrying rod (28), run during rotation of the transfer turret (15).

7. The apparatus as claimed in claim 6, wherein the carrying rods (28) are mounted displaceably in a common retaining means which is rotatable with the transfer turret (15) in a carrying body (29) on a central shaft (33) of the transfer turret.

8. The apparatus as claimed in claim 5, wherein the carrying rods (28) are supported by a supporting roller (70) at least at a free end of each carrying rod (28) adjacent to each pocket (16), the supporting roller (70) being supported on a fixed supporting path (71) against radially outwardly directed forces.

9. The apparatus as claimed in claim 7, wherein each carrying rod (28) is connected to a carriage (34) which can be displaced in a sliding manner on guide rods (35, 36), the sensing rollers (31) being fitted on the carriae (34) and passing into the control groove (30) in an outer, cylindrical housing (32) in the form of a pot.

10. The apparatus as claimed in claim 9, wherein the guide rods (35, 36) for the carriages (34) are fastened on the carrying body (29), on the one hand, and on a retaining disk (37) which is arranged at a distance parallel thereto, on the other hand, and wherein carrying body (29) and retaining disk (37) are mounted on the shaft (33) of the transfer turret (15).

11. The apparatus as claimed in claim 4, wherein the pockets (16) are fastened in a laterally offset manner, in a radially outwardly directed manner, on the carrying rods (28) by connecting webs (57) which partially enclose the carrying rods laterally.

12. The apparatus as claimed in claim 4, wherein pocket walls (20, 21) of the pockets (16) are mounted such that they can be pivoted, for the purposes of opening and closing the pockets (16), each pocket wall (20, 21) being mounted on a rotary shaft (38, 39) which can be actuated, for the purposes of opening and closing the pocket walls (20, 21), by running rollers (42, 43) which run on fixed control segments (44, 45) in the opening region of the pockets (16).

13. The apparatus as claimed in claim 12, wherein, in the region of transfer of packs (10) from one turret to another turret, the pockets (16) can be moved only in the direction of rotation of the transfer turret (15), without axial displacement in the region of the control segments (44, 45).

14. The apparatus as claimed in claim 11, wherein the pocket walls (20, 21) of the pockets (16) are always loaded in the closing direction by spring elements (48, 49).

15. The apparatus as claimed in claim 5, wherein the pockets (16) are connected in a positively locking manner to their carrying rods (28), in a region of non-circular cross-section, in of the carrying rods.

16. The apparatus as claimed in claim 14, wherein the connecting webs (57) for connecting the pockets (16) to the carrying rods (28) have a cross-sectionally U-shaped recess (58) into which the carrying rod (28) passes by means of at least a sub-region of the cross-section, the flattened portion (65) of the carrying rods (28) resting against a corresponding inner surface (66) of the recess (58).

17. The apparatus as claimed in claim 5, wherein the cross-sectionally circular carrying rod (28) of the pockets, by means of a non-circular end region (68), in a bore (67), corresponding to the cross-section of the carrying rod (28), in the carriage (34) for the purpose of transmitting the back-and-forth movement to the carrying rod (28).

18. The apparatus as claimed in claim 4, wherein the packs (10) can be introduced into open pockets (16) in the radial or tangential direction and, by way of these pockets, perform said helical movement along a virtually semicircular path.

19. An apparatus for transferring packs (10) from a rotating circular folding turret (11) to a rotating circular drying turret (12), said apparatus comprising a rotating circular transfer turret (15) having pockets (16) in which the packs (10) are received and are transported thereby, wherein the pockets (16) with the packs (10) are displaced in superposed movements along an arc of a circle and in an axial direction of said arc; wherein the folding, drying and transfer turrets rotate about respective axes which are parallel to each other and which extend in said axial direction;

wherein each of the pockets (16) of the transfer turret (15) is fastened on a carrying rod (28) which can be moved back and forth in the axis-parallel direction, carrying the rod (28) and the pocket (16) rotating about the transfer turret's axis during the displacement in the axial direction; and wherein the carrying rod (28) has a circular cross-section which fits, by means of a non-circular end region (68), in a bore (67), corresponding to the cross-section of the carrying rod (28), in a carriage (34) for the purpose of transmitting the back-and-forth movement to the carrying rod (28).

20. An apparatus for transferring packs (10) from a rotating circular folding turret (11) to a rotating circular drying turret (12), said apparatus comprising a rotating circular transfer turret (15) having pockets (16) in which the packs (10) are received and are transported thereby, wherein the pockets (16) with the packs (10) are displaced in superposed movements along an arc of a circle and in an axial direction of said arc; wherein the folding, drying and transfer turrets rotate about respective axes which are parallel to each other and which extend in said axial direction; and wherein the packs (10) are introduced into open ones of said pockets (16) in the radial or tangential direction and, by way of these pockets, are subjected to a helical movement along a virtually semicircular path.

* * * * *